US006741054B2

(12) United States Patent
Koselka et al.

(10) Patent No.: US 6,741,054 B2
(45) Date of Patent: May 25, 2004

(54) AUTONOMOUS FLOOR MOPPING APPARATUS

(75) Inventors: Harvey Koselka, Trabuco Canyon, CA (US); Bret A. Wallach, San Diego, CA (US); David Gollaher, San Diego, CA (US)

(73) Assignee: Vision Robotics Corporation, San Diego, CA (US)

( * ) Notice: Subject to any disclaimer, the term of this patent is extended or adjusted under 35 U.S.C. 154(b) by 19 days.

(21) Appl. No.: 09/847,598

(22) Filed: May 2, 2001

(65) Prior Publication Data

US 2002/0011813 A1 Jan. 31, 2002

Related U.S. Application Data

(60) Provisional application No. 60/201,168, filed on May 2, 2000.

(51) Int. Cl.[7] ..... B25J 9/18; B25J 5/00; A47L 11/00; A47L 1/02

(52) U.S. Cl. ..... 318/445; 318/598.11; 318/568.12; 15/3; 15/97.1

(58) Field of Search ..... 318/567, 568.1, 318/568.11, 568.12, 568.21, 445; 15/3, 4, 97.1, 98, 99, 102, 103, 103.5, 105, 118, 159.1, 250, 34

(56) References Cited

U.S. PATENT DOCUMENTS

| | | | | |
|---|---|---|---|---|
| 1,130,064 A | 3/1915 | Buchanan | 15/228 |
| 3,604,037 A | 9/1971 | Varner | 15/4 |
| 3,868,738 A | 3/1975 | Horst et al. | 15/4 |
| 4,510,642 A | 4/1985 | Ingermann et al. | 15/231 |
| 4,550,467 A | 11/1985 | Johnson et al. | 15/228 |
| 4,647,784 A | 3/1987 | Stephens | 250/561 |
| 4,709,265 A | 11/1987 | Silverman et al. | 358/108 |
| 4,852,210 A | 8/1989 | Krajicek | 15/228 |
| 4,854,000 A | 8/1989 | Takimoto | 15/3 |

(List continued on next page.)

FOREIGN PATENT DOCUMENTS

| | | | | |
|---|---|---|---|---|
| DE | 195 44 999 A | | 6/1997 | |
| DE | 198 49 978 A | | 5/2000 | |
| JP | 11178765 A | * | 7/1999 | A47L/11/24 |
| JP | 2001-325023 | | 11/2001 | |
| JP | 2001-325024 | | 11/2001 | |
| WO | WO 91 11134 A | | 8/1991 | |
| WO | WO 01/37060 A1 | | 5/2001 | |

OTHER PUBLICATIONS

"Robot Spatial Perception by Stereoscopic Vision and 3D Evidence Grids" by Hans Moravec, Robotics Institute, Carnegie Mellon University, Pittsburgh, PA Sep. 1996.

* cited by examiner

*Primary Examiner*—Robert Nappi
*Assistant Examiner*—Patrick Miller
(74) *Attorney, Agent, or Firm*—Knobbe Martens Olson & Bear LLP

(57) ABSTRACT

A floor mopping assembly finding use in a cleaning robot. The cleaning robot may be remotely controlled or autonomous. In one embodiment, a feed roller lets out a roll of webbing or toweling, a take-up roller reels in the toweling, and a motor system causes transfer of the toweling between the feed roller and the take-up roller. A housing holds the motor system and the rollers, which are mounted in the housing such that the motor causes transfer of the webbing between the rollers. One of the rollers is configured to rest on the floor or surface so as to cause the toweling to clean the surface. In an alternative embodiment, the assembly also includes a pad to press the toweling against the surface, where the pad is mounted in the housing such that the motor causes transfer of the toweling between the rollers and between the pad and the surface.

37 Claims, 5 Drawing Sheets

Figure 3

U.S. PATENT DOCUMENTS

| | | | | | |
|---|---|---|---|---|---|
| 5,071,489 | A | | 12/1991 | Silvenis et al. | 134/42 |
| 5,086,262 | A | | 2/1992 | Hariki et al. | 318/568.1 |
| 5,092,699 | A | | 3/1992 | Silvenis | 401/21 |
| 5,179,329 | A | | 1/1993 | Nishikawa et al. | 318/587 |
| 5,220,263 | A | | 6/1993 | Onishi et al. | 318/587 |
| 5,254,923 | A | | 10/1993 | Kanitani | 318/568.11 |
| 5,266,875 | A | | 11/1993 | Slotine et al. | 318/568.11 |
| 5,327,609 | A | * | 7/1994 | Bierma et al. | 15/98 |
| 5,333,242 | A | | 7/1994 | Watanabe et al. | 395/89 |
| 5,382,885 | A | | 1/1995 | Salcudean et al. | 318/598.11 |
| 5,488,277 | A | | 1/1996 | Nishikawa et al. | 318/587 |
| 5,555,587 | A | | 9/1996 | Guha | 15/98 |
| 5,568,030 | A | | 10/1996 | Nishikawa et al. | 318/587 |
| 5,735,959 | A | | 4/1998 | Kubo et al. | 118/663 |
| 5,819,008 | A | | 10/1998 | Asama et al. | 395/90 |
| 5,825,149 | A | | 10/1998 | Matsumoto et al. | 318/587 |
| 5,825,813 | A | | 10/1998 | Na | 375/219 |
| 5,825,981 | A | | 10/1998 | Matsuda | 395/83 |
| 5,867,800 | A | | 2/1999 | Leif | 701/23 |
| 5,959,423 | A | * | 9/1999 | Nakanishi et al. | 318/568.12 |
| 5,968,281 | A | | 10/1999 | Wright et al. | 134/6 |
| 5,991,951 | A | | 11/1999 | Kubo et al. | 15/50.1 |
| 6,101,671 | A | | 8/2000 | Wright et al. | 15/365 |
| 6,142,252 | A | * | 11/2000 | Kinto et al. | 180/204 |
| 6,223,378 | B1 | * | 5/2001 | Watellier | 15/103.5 |
| 6,252,544 | B1 | | 6/2001 | Hoffberg | 342/357.1 |
| 6,374,155 | B1 | | 4/2002 | Wallach et al. | 700/245 |
| 6,389,329 | B1 | * | 5/2002 | Colens | 180/167 |
| 6,459,955 | B1 | * | 10/2002 | Bartsch et al. | 700/245 |

OTHER PUBLICATIONS

Hashimoto, et al., "Coordinative Object–Transportation by Multiple Industrial Mobile Robots Using Coupler with Mechanical Compliance", Proceedings of the International Conference on Industrial Electronics, Control, and Instrumentation (IECON), IEEE, pp. 1577–1582, Nov. 15,1993.

Kotay, et al., Task–reconfigurable robots: Navigators and Manipulators, 1997, IEEE, pp. 1081–1089 (1997).

Beom, et al., "A Sensor–Based Navigation for a Mobile Robot Using Fuzzy Logic and Reinforcement Learning", IEEE Transactions on Systems, Man, and Cybermetics, vol. 25, No. 3, Mar. 1995, pp. 464–477.

Baloch, et al., "A Neural System for Behavioral Conditioning of Mobile Robots", 1990, IEEE, pp. 723–728.

Marco, et al., "Local Area Navigation Using Sonar Feature Extraction and Model Based Predictive Control", 1996, IEEE, pp. 67–77 (1996).

Yuta, et al., "Coordinating Autonomous and Centralized Decision Making to Achieve Cooperative Behaviors Between Multiple Mobile Robots", Proceedings of the IEEE/RSJ International Conference on Intelligent Robots and Systems, IEEE, pp. 1566–1574, Jul. 7, 1992.

Ozaki, et al., "Synchronized Motion by Multiple Mobile Robots Using Communication", Proceedings of the IEEE/RSJ International Conference on Intelligent Robots and Systems, IEEE, pp. 1164–1170, Jul. 26, 1993.

Kurazume, et al., "Cooperative Positioning with Multiple Robots", Proceedings of the International Conference on Robotics and Automation, IEEE Comp. So. Press, Vol. Conf. 11, pp. 1250–1257, May 8, 1994.

Ishida, et al., "Functional Complement by Cooperation of Multiple Autonomous Robots", Proceedings of the International Conference on Robotics and Automation, IEEE Comp. Soc. Press, Vol. Conf. 11, pp. 2476–2481, May 8, 1994.

Prassler, et al., Tracking People in a Railway Station During Rush–Hour, *International Computer Vision Systems Proceedings*, pp. 162–179, Jan. 1999.

Prassler, et al., Maid: A Robotic Wheelchair Operating in Public Environments, Sensor Based Intelligent Robots, International Workshop, pp. 68–95, Sep. 1998.

Florini, et al., "Cleaning and Household Robots: A Technology Survey", Autonomous Robots 9, pp. 227–235, 2000.

Prassler, et al., "A Short History of Cleaning Robots", Autonomous Robots 9, pp. 211–226, 2000.

Prassler, et al., "Tracking Multiple Moving Objects for Real–Time Robot Navigation", Autonomous Robots 8, pp. 105–116, 2000.

Rekleitis, et al., "Multi–Robot Exploration of an Unknown Environment, Effieciently Reducing the Odometry Error", 1997.

Rekleitis, et al., "Reducing Odometry Error Through Cooperating Robots During the Exploration of an Unknown World", 1997.

Dudek, et al., "Robust Positioning with a Multi–Agent Robotic System", 1993.

Prassler, et al., "Robot Technology Improving Human Lifestyle", www.nt. nada.kth.se/numero/1999/99.15.html. Apr. 23, 1999.

Machine Maid, *Technology Review*, p. 20, Jul./Aug. 2001.

* cited by examiner

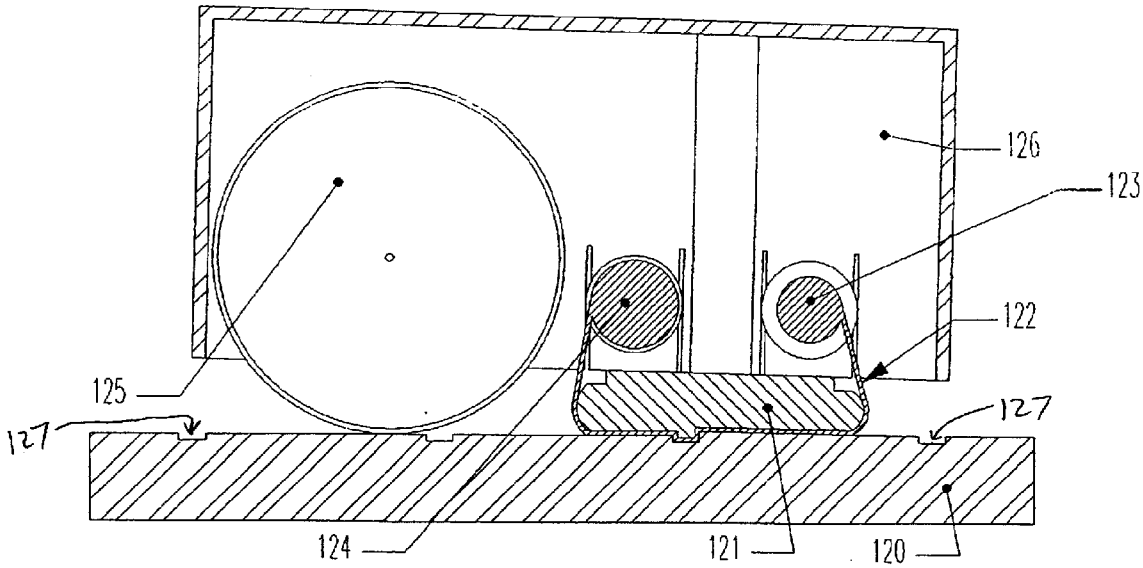
Figure 3
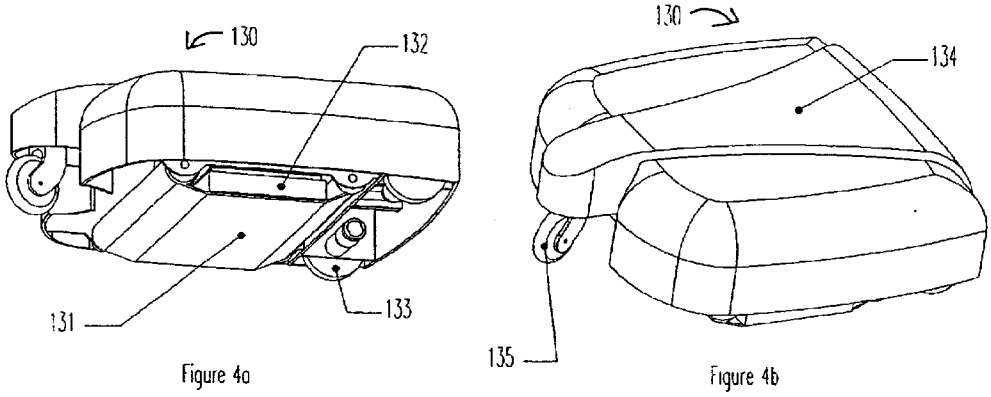
Figure 4a
Figure 4b
Figure 4

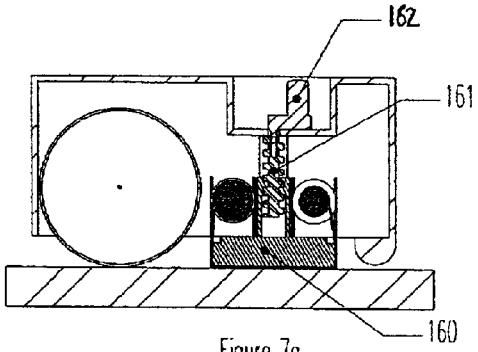
Figure 7a
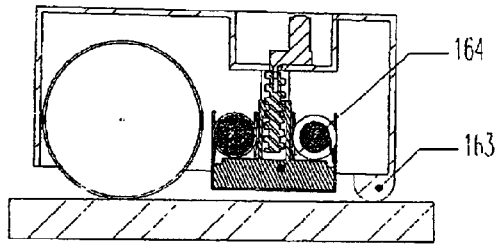
Figure 7b
Figure 7

AUTONOMOUS FLOOR MOPPING APPARATUS

RELATED APPLICATIONS

This application claims the benefit of the filing date of U.S. patent application Ser. No. 60/201,168, entitled "REMOTE CONTROLLED FLOOR MOPPING APPARATUS", filed on May 2, 2000, which is hereby incorporated by reference.

This patent application is related to U.S. patent application Ser. No. 09/847,600 for "APPARATUS AND METHOD FOR IMPROVING TRACTION FOR A MOBILE ROBOT", concurrently filed May 2, 2001, and which is hereby incorporated by reference.

BACKGROUND

1. Field of the Invention

Aspects of the present invention relate to automated, robotic floor mopping. More specifically, embodiments of the present invention relate to a unique electric floor cleaning system that can be incorporated into a wide variety of robot or remote control platforms.

2. Description of the Related Technology

Robotic technology is under development in many academic and industrial environments. A great challenge for mobile robots is robust navigation, which has been solved in a variety of applications. Computer processing power, batteries, electronic sensors such as cameras, and efficient electric motors are all either just becoming available, cost effective or reliable enough to use in consumer robots. Industry has finally reached the point where commercial success of household robots has become an implementation issue, rather than a technology issue.

Mobile robots have been designed, developed and deployed to handle a variety of tasks, such as manufacturing and security. As robots become more prevalent in society, they will continue to automate tasks currently performed by people. Household cleaning and maintenance is an obvious application for robotics, and pool cleaning, lawn mowing and vacuuming robots have been developed.

Mopping is another obvious candidate for automation, but automated mopping is not as simple as making a robot that mops like a person. The methods humans use to perform household tasks have evolved over time based on the tools available, but a robot will not necessarily perform tasks in the same manner as a person. For example, people use their arms and legs to walk and work, while most robots use motors and wheels.

While it is possible to automate current manual or electric mopping devices and methods, the result would be a poorly performing machine based on a compromise of ideas. People clean surfaces, such as floors, using mops and buckets of water. A mopping robot would have to be large enough to hold both clean and dirty water reservoirs, and, therefore, could not clean small, hard-to-reach areas. The clean water and cleaning solution require refilling, the dirty water needs emptying, and the mop head needs to be cleaned and occasionally replaced. Water and drains would need to be plumbed to locations the robot could reach. Even if this was done in new construction, leaks in the robot or in the filling station would be potentially catastrophic. Designing failsafe machines to work with water is complicated and expensive. Therefore, a robot mop needs a unique and innovative cleaning apparatus to work effectively.

Most mopping is done manually with a mop and a bucket of water. The Swiffer™ is a product that uses small disposable towels to damp mop smooth floors. In addition to being a manual device, this product is inconvenient because it is does not deep clean and each individual towel only cleans a small area. Current electric mopping machines and waxers use spinning brushes, either flat disks that spin on an axis perpendicular to the ground or cylindrical brushes that spin on an axis parallel to the ground.

Another mopping approach uses a long damp towel on two rollers. The towel in this system is configured similar to a scroll such that it is wound on two rollers, feed and take-up reels, mounted on a handle. Typically, the feed reel is exposed, and the user presses it against the ground to mop. When the area of towel gets dirty, the user manually winds the towel further onto the take-up reel to expose a clean towel area. Trigger mechanisms that wind the towel with a press of a button have also been developed. A disposable cartridge/towel system has also been developed for this type of mopping approach.

A robot mopping system is appealing to consumers. However, all the heretofore proposed robot mops are simply automated versions of electric mopping devices. A variety of water and plumbing issues make the viability of such a system questionable.

SUMMARY OF THE INVENTION

Aspects of the present invention are directed toward a system and method of automated, robotic floor mopping. The unique electric cleaning system can be incorporated into a wide variety of robot or remote control platforms. One embodiment includes a fully automated robotic floor mopping machine that damp mops the floor using a pre-moistened roll of towels or webbing that automatically advances from a feed roll to a take-up roll. While this embodiment is directed to a self-contained robot mopping apparatus, another embodiment of the mopping system could also be incorporated in a slave platform that operates in conjunction with a controller robot.

Unlike all current electric and robot mopping devices that use spinning brushes and onboard water reservoirs, this system uses a pre-moistened web or towel on a roller system. The general cleaning process is similar to how a person works with a sponge. The robot moves back and forth while pressing the towel against the floor. Instead of rinsing the towel, the robot turns its rollers exposing a clean section of towel. For convenience, the towel can be delivered on a roll that is pre-moistened with a cleaning solution and is disposable.

While it is possible to use the take-up or feed reel as the cleaning head, such as in previous mechanical devices, one embodiment presses the towel against the floor by a pliable, sponge-like object. The dual benefits are increasing the size of cleaning area, and the soft pressure improves cleaning because the towel will contour to irregularities in the floor such as grout between tiles.

Typically, the roll of toweling is transferred between two reels at a controlled rate as the robot moves in a mopping motion across the floor. However, the robot can use optical or other sensors to determine when the exposed portion of the towel is dirty and advance the towel on the reels when appropriate. Research has shown that one square foot of toweling cleans approximately 25 square feet of flooring. The towel can be made of any cloth, paper or other appropriate material, but a tough, disposable paper-based material is preferable in one embodiment. Simple water can be used as the cleaning solution, but adding soap or other cleaner improves the mop efficacy. It is also feasible to use a dry towel and have the robot apply a cleaning solution. This necessitates a reservoir on the robot in one embodiment.

In one aspect of the present invention, there is a floor mopping assembly, comprising a first roller configured to let out a web mounted on a roll; a second roller configured to reel in the web; a motor system configured to cause transfer of the web between the first roller and the second roller; a pad configured to press the web against a surface; and a housing to enclose the motor system, the first roller, the second roller and the pad, wherein the motor system, the first and second rollers, and the pad are mounted in the housing such that the motor causes transfer of the web between the first and second rollers and between the pad and the surface.

In another aspect of the present invention, there is a floor mopping assembly, comprising a computerized mobile chassis, a first roller configured to let out a roll of webbing, a second roller configured to reel in the webbing, and a motor system configured to cause transfer of the webbing between the first roller and the second roller, wherein the motor system and the first and second rollers are conveyed by the chassis.

In another aspect of the present invention, there is a floor mopping assembly, comprising a computerized mobile chassis, a first means for letting out a portion of webbing, a second means for taking up the webbing, and a motor means for causing transfer of the webbing between the first means and the second means.

In yet another aspect of the present invention, there is a method of mopping a surface with a floor mopping device, the method comprising a) connecting a roll of webbing on a feed roller to a take-up roller, b) moving the floor mopping device without human intervention, c) pressing on a portion of the webbing such that the webbing cleans the surface, and d) transferring the portion of the webbing to the take-up roller.

BRIEF DESCRIPTION OF THE DRAWINGS

FIG. 3 is a sectional view diagram of the single robot, automated floor mopping device shown in FIG. 1 further showing the towel, feed and take-up rollers and the pliable cleaning head conforming to irregularities to the floor shape.

FIG. 4*a* and FIG. 4*b* are lower and upper perspective view diagrams, respectively, of an embodiment of a remotely controlled, automated floor-mopping device.

FIGS. 7*a* and 7*b* show a mechanism in schematic form that raises and lowers the towel mechanism as may be used in the automated floor mopping device shown in FIGS. 1 and 4.

DETAILED DESCRIPTION

The following detailed description presents a description of certain specific embodiments of the present invention. However, the present invention may be embodied in a multitude of different ways as defined and covered by the claims. In this description, reference is made to the drawings wherein like parts are designated with like numerals throughout.

Aspects of the present invention are directed towards a system and robotic or remote control method for mopping a floor. In particular, the system overcomes the drawbacks of having a mopping device carry reservoirs of clean and dirty water as well as a detergent or other cleaning or waxing solutions.

Figure 1:
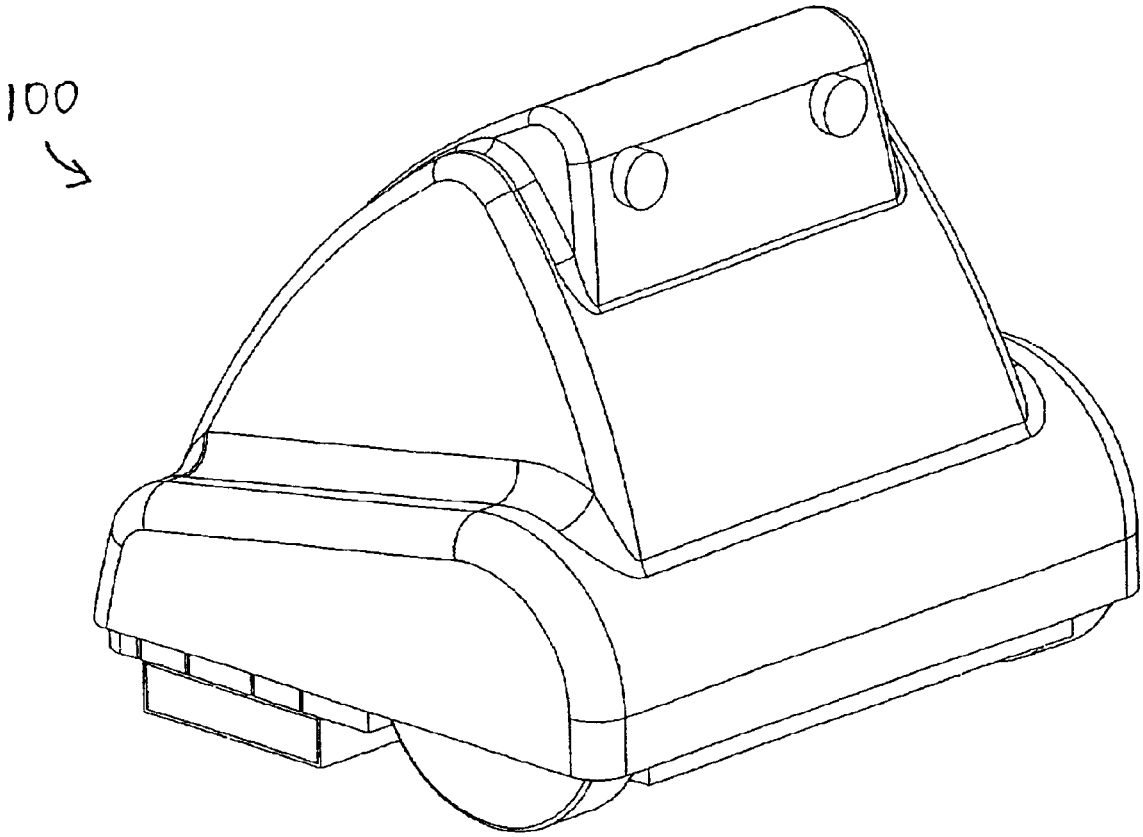
FIG. 1 is a front perspective diagram of a single robot embodiment of an automated floor-mopping device.

FIG. 1 shows a front perspective of one embodiment of an autonomous robot mop 100. The overall shape and configuration of the robot may affect its ability to autonomously clean and navigate an environment, but generally does not affect, nor is affected by, the automated floor-mopping aspects of this invention.

Figure 2:
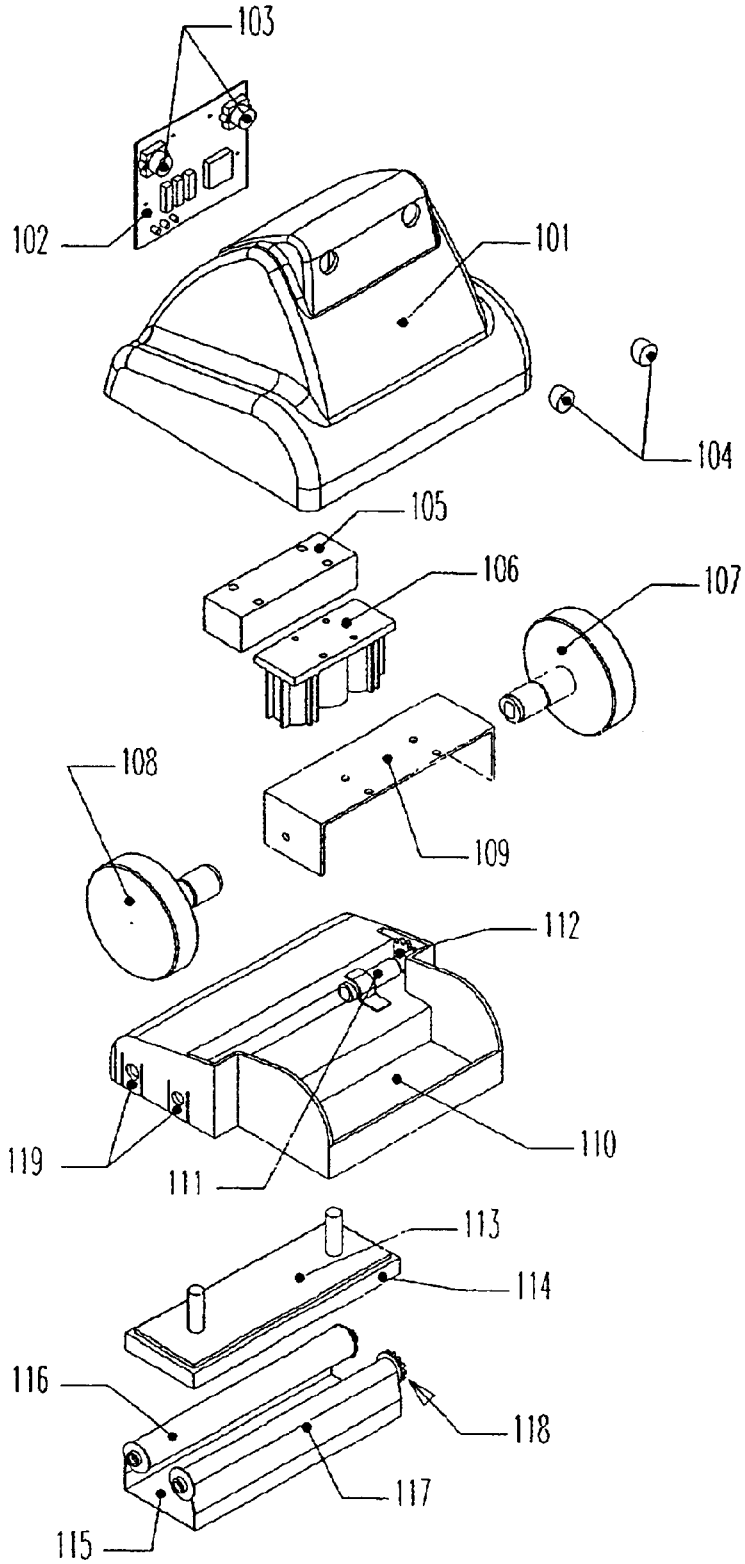
FIG. 2 is an exploded view diagram of exemplary components of the single robot, automated floor mopping device shown in FIG. 1.

FIG. 2 is an exploded view of the robot mop 100 embodiment shown in FIG. 1. Wires, hardware and other components have been removed in the view of FIG. 2 for simplification. In one embodiment, the robot is housed inside a plastic shell 101, and controlled by a custom computer assembly 102 that includes a Central Processing Unit (CPU) or processor, Random Access Memory (RAM), and non-volatile storage. There are many CPUs that are sufficient for use including, for example, those manufactured by Intel, Motorola, and Microchip (PIC). The computer assembly 102 processes information received from sensors 103 to determine its position, the room types and so on, in order to determine what should be done next. Additionally, the computer assembly 102 controls all the motors on the robot in one embodiment. Information about the environment, such as a map and task schedule, is maintained in non-volatile memory. The computer assembly 102 includes two camera sensors 103 that view through lenses 104 to provide stereo vision. Wide angle lenses such as those found in some readily available Web and security cameras are preferred in this embodiment. While cameras are the sensors in one embodiment, the robot can also use ultrasonic, radar or lidar sensors in place of or in conjunction with the cameras. The cameras are the primary sensors facing the forward direction, and additional cameras or other sensors may optionally be oriented around the periphery of the robot. The robot may also use short range ultrasonic or touch sensors, floor type sensors or other additional ways to improve its performance.

A left drive wheel and drive motor assembly 107 and a right drive wheel and drive motor assembly 108 mounted on a bracket 109 within the shell propel the robot 100. A battery 106 powers the system. Ideally, the battery 106 provides sufficient voltage for the computer, sensors and motors. Otherwise, the system may require one or more transformers. In one embodiment, a rechargeable battery is utilized and is sized to provide an hour or more of power for the robot to effectively clean between charges. NiCad, lithium ion, lead acid and other battery technologies may be successfully used. The mopping system is mounted on a bottom plastic shell 110. It includes a pre-moistened web or towel 115 assembled onto a feed roll, reel or roller 116 and a take-up roll 117. The entire towel assembly is configured in a manner similar to a scroll where the paper is wound from one roll onto the other roll. The ends of both rollers 116, 117 have details that snap into mating features 119 on the lower shell 110. One end of the take-up roll has a gear 118 that meshes with a gear 112 mounted on a towel drive motor 111. When the towel 115 is in place within the robot 100, the cleaning area passes over a non-absorbent cushioning pad 114 adhered to a mounting plate 113, which may be a solid mounting plate. One or more weights 105 may be added to the robot system to ensure that the towel 115 is pressed against the floor with an appropriate pressure. In one embodiment, closed cell foams are utilized for the pad because they are durable and do not absorb water. However, self-skinning open cell foams such as urethane and neoprene are acceptable as are other sponge type materials enclosed in a watertight bag.

As the robot 100 moves back and forth across the floor of an area or room, the towel 115 mops the floor. During use, the towel is transferred between the feed reel 116 and the take-up reel 117 at a controlled rate. Tests indicate that one square foot of towel can clean approximately 25 square feet of floor. The computer assembly 102 can advance the towel a specific amount based on the amount of floor that is cleaned. Alternatively, the robot 100 could include a sensor, such as a camera, to determine when the active cleaning area of the towel is dirty. One embodiment uses one motor 111 on the take-up reel 117 and assumes there is sufficient friction on the feed reel 116 to prevent it from inadvertently unwinding in use. Alternate embodiments can include drive motors on both rollers and/or clutches or friction brakes to ensure tension on the towel.

In one embodiment, the towel 115 is embodied in a disposable assembly that snaps into the robot and is removed when the entire length has been used. A paper-based towel similar to a paper towel or a handiwipe™ is used in one embodiment, but a cloth towel is an alternative. Alternatively, a non-disposable cloth towel could be removed and washed between uses. Regardless of the material, the towel is to be pre-moistened. Adding soap or other cleaning agent to the mixture improves the cleaning characteristics. Similarly, the towel could be pre-moistened with a wax so as to wax, rather than mop, a floor.

In many embodiments, a length of the towel on the roll is independent of the amount of towel needed to clean the floor. Therefore, the towel may remain on the robot mop for an indefinite period. For these embodiments, it may be preferable to encase the feed roll in a watertight compartment including a seal around where the towel exits the compartment. This will enable the towel to remain wet between uses.

Minimizing the robot size allows it to clean smaller spaces. However, the smaller the robot, the smaller the towel roll it can carry and the smaller the amount of floor it can clean before the towel needs replacing. An alternative is to provide a large roll of toweling and have the robot automatically load a length of towel as required. The robot can either load a standard length, or it could determine the amount it needs for a day and take that amount. In such an automated system, the robot disposes of the dirty towels.

As shown in FIG. 3, the use of the non-absorbent pad 121 (which is similar to the pad 114) offers several improvements to previous cleaning devices. It provides a relatively large cleaning surface and ensures constant pressure when the towel 122 (which is similar to towel 115) is pressed against a surface or floor 120. The towel is transported from a feed roller 123 to a take-up roller 124 In one embodiment, the pad 121, the towel 122, the feed roller 123, the take-up roller 124, and drive wheels 125 (only one wheel is shown) are configured in a robot housing 126 as shown. In another embodiment, the position of the feed roller and the take-up roller may be interchanged. Since the pad is soft and compliant in one embodiment, it conforms to irregularities in the floor, such as grout lines 127 in tile flooring. This feature improves the cleaning ability of the robot mopping system.

FIG. 4 shows a top perspective view (FIG. 4*b*) and bottom perspective view (FIG. 4*a*) of a remotely controlled mopping device 130. This device 130 includes a pre-moistened cleaning towel 131, a non-absorbent cushioning pad 132 and a drive system 133 mounted in a plastic shell 134. However, the mopping device 130 does not include the sensors and electronics to autonomously navigate through its environment. A person using a joystick or other similar controller could control this device in a manner similar to that done with toy cars.

Figure 5:
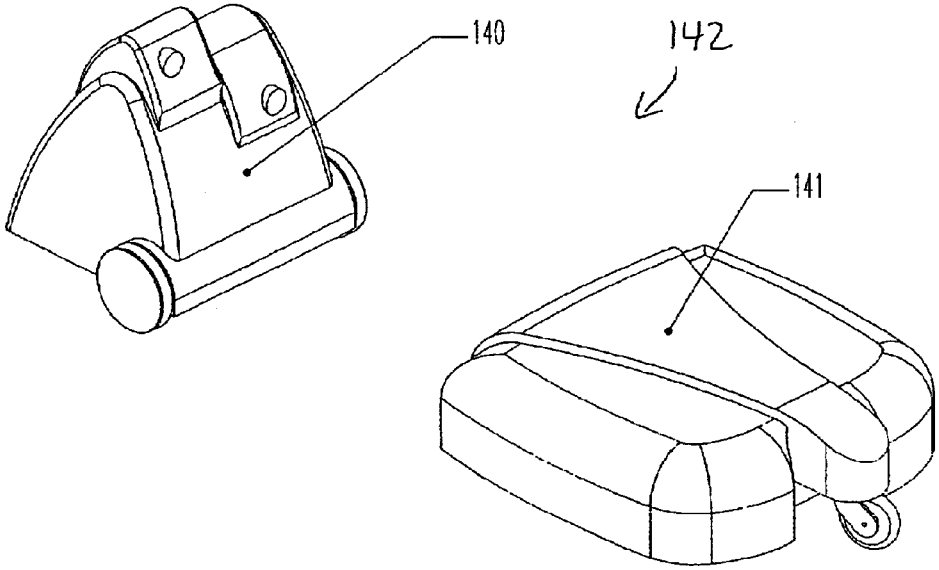
FIG. 5 is a front perspective diagram of an embodiment of a remote control, automated floor mopping device under the direction of an independent controller robot.

Alternatively, the mopping device could be a slave robot in a master/slave system 142 such as shown in FIG. 5. In this configuration, the mop 141 (which is similar to the mopping device 130) performs the cleaning under the control of the master robot 140. The master robot 140 includes most or all of the electronics and sensors, and directs the slave's movement such as described in Applicant's copending U.S. patent application Ser. No. 09/449,177, filed on Nov. 24, 1999, entitled "Autonomous Multi-Platform Robot System", which is hereby incorporated by reference. In this system 142, a single control robot such as master robot 140 could work with multiple cleaning devices, such as sweepers and vacuums. It is possible for the master controller to be a stationary computer provided there are sufficient sensors for it to track the slave device throughout a house or other building.

Referring again to FIG. 4, a leading (or trailing) wheel 135 that is not on the same axis as the drive system 133 may be incorporated into the robot or remote device to improve the drive system. In such a three wheel system, or alternatively, in a four or more wheel system, the robot or remote device is balanced better than a two wheel system and the extra wheel(s) provides a limit as to how much the absorbent pad 132 can be compressed by the weight of the robot or device 130. Therefore, such (wheels in more than one axis) configurations provide for the absorbent pad 132 to be compressed by a specific and constant amount. Alternatively, the foam pad 132 can be weighted or spring loaded to apply a specific and constant cleaning pressure to the towel that is less than the weight of the entire robot 130.

Figure 6:
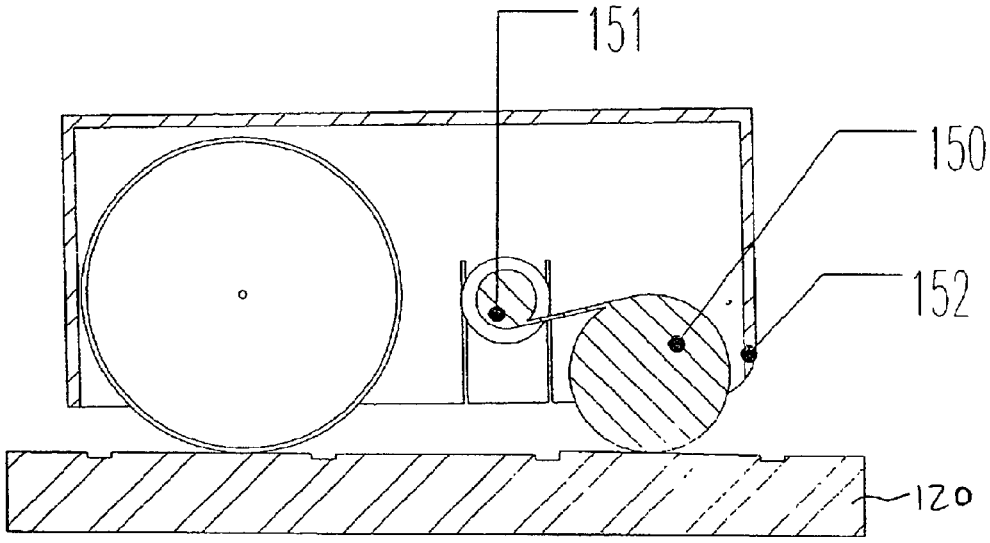
FIG. 6 is a sectional view diagram showing the feed roll as the cleaning head as may be used in the automated floor mopping device shown in FIGS. 1 and 4.

As shown in FIG. 6, it is possible to remove the non-absorbent pad, such as pad 121 shown in FIG. 3, and have either the feed roll 150 or the take-up roll 151 directly contact the floor as in similar non-automated systems. The robot housing 152 and the entire robot system is designed to adjust for the change in size of the towel roll. In one embodiment, the housing adapts mechanically because the height of the contact area changes as the towel is transferred between rolls. Electronically, the feed rate also varies because the effective cleaning head changes size during use.

FIGS. 7*a* and 7*b* show an embodiment where a motor 162 and lead screw 161 raise the non-absorbent pad from a lowered position 160 (FIG. 7*a*) to a raised position 164 (FIG. 7*b*) when the device is not mopping. In this embodiment, the robot mop rides on a skid pad 163, or a trailing wheel, when the pad is raised. This configuration enables the robot to traverse a floor, such as carpet, without mopping it. Raising the pad to position 164 also helps the robot move if it gets stuck or if the wheels slip.

In an alternate embodiment, the robot can automatically load the towel from a base station. The system can either change an entire towel cartridge, or can wind the towel from a large roll using a feed mechanism similar to a movie projector or printer. In this situation, the robot can calculate and the load the amount of towel required to mop the floor.

Conclusion

Specific blocks, sections, devices, functions and modules may have been set forth. However, a skilled technologist will realize that there are many ways to partition the system of the present invention, and that there are many parts, components, modules or functions that may be substituted for those listed above.

While the above detailed description has shown, described, and pointed out the fundamental novel features of the invention as applied to various embodiments, it will be understood that various omissions and substitutions and changes in the form and details of the system illustrated may be made by those skilled in the art, without departing from the intent of the invention.

What is claimed is:

1. A floor mopping assembly, comprising:

a first roller configured to let out a web mounted on a roll;

a second roller configured to reel in the web;

a motor system configured to cause transfer of the web between the first roller and the second roller;

a pad configured to press the web against a surface; and a housing to enclose the motor system, the first roller, the second roller and the pad, wherein the motor system, the first and second rollers, and the pad are mounted in the housing such that the motor causes transfer of the web between the first and second rollers and between the pad and the surface, and wherein the housing is part of an autonomous cleaning robot, and wherein the autonomous cleaning robot offloads the web after it has been soiled.

2. A floor mopping assembly, comprising:

a first roller configured to let out a web mounted on a roll;

a second roller configured to reel in the web;

a motor system configured to cause transfer of the web between the first roller and the second roller;

a pad configured to press the web against a surface, wherein the pad is compliant and non-absorbent; and a housing to enclose the motor system, the first roller, the second roller and the pad, wherein the motor system, the first and second rollers, and the pad are mounted in the housing such that the motor causes transfer of the web between the first and second rollers and between the pad and the surface, and wherein the floor mopping assembly automatically loads or offloads a length of the web.

3. A floor mopping assembly, comprising:

a first roller configured to let out a web mounted on a roll, wherein the roll of web is encased in a watertight compartment;

a second roller configured to reel in the web;

a motor system configured to cause transfer of the web between the first roller and the second roller;

a pad configured to press the web against a surface; and a housing to enclose the motor system, the flrst roller and its watertight compartment, the second roller, and the pad, wherein the motor system, the first and second rollers, and the pad are mounted in the housing such that the motor causes transfer of the web between the first and second rollers and between the pad and the surface.

4. A floor mopping assembly, comprising:

a first roller configured to let out a web mounted on a roll, wherein the roll of web is encased in a disposable assembly;

a second roller configured to reel in the web;

a motor system configured to cause transfer of the web between the first roller and the second roller;

a pad configured to press the web against a surface; and a housing to enclose the motor system, the first roller, the second roller and the pad, wherein the motor system, the first and second rollers, and the pad are mounted in the housing such that the motor causes transfer of the web between the first and second rollers and between the pad and the surface.

5. A floor mopping assembly, comprising:

a computerized mobile chassis;

a first roller configured to let out a roll of moistened webbing, wherein the roll of webbing is encased in a watertight compartment;

a second roller configured to reel in the webbing; and a motor system configured to cause transfer of the webbing between the first roller and the second roller, wherein the motor system, the first roller and its watertight compartment, and the second roller are conveyed by the chassis.

6. A floor mopping assembly, comprising:

a computerized mobile chassis;

a first roller configured to let out a roll of webbing, wherein the roll of webbing is encased in a disposable assembly;

a second roller configured to reel in the webbing; and a motor system configured to cause transfer of the webbing between the first roller and the second roller, wherein the motor system and the first and second rollers are conveyed by the chassis.

7. A method of mopping a surface with a floor mopping device, the method comprising:

a) connecting a roll of webbing on a feed roller to a take-up roller;

b) moving the floor mopping device without human intervention;

c) pressing on a portion of the webbing such that the webbing cleans the surface; and d) transferring the portion of the webbing to the take-up roller, wherein the transferring includes determining when the webbing is soiled.

8. A method of mopping a surface with a floor mopping device, the method comprising:

a) connecting a roll of webbing on a feed roller to a take-up roller;

b) moving the floor mopping device without human intervention;

c) pressing on a portion of the webbing such that the webbing cleans a surface; and d) transferring the portion of the webbing to the take-up roller, wherein the transferring includes determining when the mopping device has cleaned a predetermined area of the surface.

9. A floor mopping system, comprising:

a floor mopping assembly, comprising:

a first roller configured to let out a web mounted on a roll;

a second roller configured to reel in the web;

a motor system configured to cause transfer of the web between the first roller and the second roller;

a pad configured to press the web against a surface; and a housing to enclose the motor system, the first roller, the second roller and the pad, wherein the motor system, the first and second rollers, and the pad are mounted in the housing such that the motor causes transfer of the web between the first and second rollers and between the pad and the surface; and a master controller separately housed from the floor mopping assembly, in data communication with the floor mopping assembly, and configured to control the floor mopping assembly, wherein the master controller is an autonomous mobile robot.

10. The system of claim 9, wherein the housing is part of a cleaning robot.

11. The system of claim 9, wherein the master controller includes sensors.

12. The system of claim 9, wherein the master controller directs movement of the floor mopping assembly.

13. The system of claim 9, wherein the master controller is a stationary computer.

14. The system of claim 9, wherein the system includes one or more additional floor mopping assemblies controlled by the master controller.

15. The system of claim 9, wherein the pad is closed-cell foam or self-skinning open-cell foam.

16. The system of claim 9, wherein a portion of the roll of web is moistened prior to being pulled by the motor driven roller.

17. The system of claim 9, wherein the web comprises a paper-based material.

18. The system of claim 9, wherein the web comprises a cloth-based material.

19. A floor mopping system, comprising:

a floor mopping assembly, comprising:

a computerized mobile chassis;

a first roller configured to let out a roll of webbing;

a second roller configured to reel in the webbing; and a motor system configured to cause transfer of the webbing between the first roller and the second roller, wherein the motor system and the first and second rollers are conveyed by the chassis; and a master controller separately housed from the floor mopping assembly, in data communication with the floor mopping assembly, and configured to control the floor mopping assembly, wherein the master controller is an autonomous mobile robot.

20. The system of claim 19, wherein the master controller includes sensors.

21. The system of claim 19, wherein the master controller directs movement of the floor mopping assembly.

22. The system of claim 19, wherein the master controller is a stationary computer.

23. The system of claim 19, wherein the system includes one or more additional floor mopping assemblies controlled by the master controller.

24. The system of claim 19, wherein the chassis includes at least one drive motor configured to provide mobility.

25. The system of claim 19, wherein the chassis includes a processor configured to control the motor system.

26. A floor mopping system, comprising:

means for floor mopping, comprising:

a computerized mobile chassis;

first means for letting out a portion of webbing;

second means for taking up the webbing; and motor means for causing transfer of the webbing between the first means and the second means; and control means, separately housed from the means for floor mopping, and in communication with the means for floor mopping, for controlling the means for floor mopping, wherein the control means is configured to autonomously navigate through an environment.

27. A method of mopping a surface with a floor mopping device, the method comprising:

a) connecting a roll of webbing on a feed roller to a take-up roller;

b) transmitting control signals from an autonomous master controller to the floor mopping device, wherein the autonomous master controller comprises one or more navigation sensors;

c) moving the floor mopping device based on the control signals;

d) sensing the movement of the floor mopping device using the navigation sensors thereby tracking the location of the floor mopping device;

e) pressing on a portion of the webbing such that the webbing cleans a surface; and f) transferring the portion of the webbing to the take-up roller.

28. The method of claim 27, additionally comprising repeating b)–e) whereby an entire floor surface is mopped clean.

29. The method of claim 27, wherein the transferring includes moving the webbing via a motor system.

30. The method of claim 27, additionally comprising moistening a predetermined amount of the webbing prior to the pressing.

31. The method of claim 30, wherein the moistening comprises applying a cleaning agent to the webbing.

32. The method of claim 30, wherein the moistening comprises applying a wax to the webbing, such that the surface is waxed.

33. A floor mopping system, comprising:

a floor mopping assembly, comprising:

a computerized mobile chassis;

a first roller configured to let out a roll of webbing;

a second roller configured to reel in the webbing;

a motor system configured to cause transfer of the webbing between the first roller and the second roller, wherein the motor system and the first and second rollers are conveyed by the chassis; and a housing to enclose the chassis, the motor system, the first roller and the second roller, wherein the motor system, and the first and second rollers, are mounted such that the motor causes transfer of the webbing between the first and second rollers and one of the rollers is configured to rest on a surface; and a master controller separately housed from the floor mopping assembly, in data communication with the floor mopping assembly, and configured to control the floor mopping assembly.

34. A method of mopping a surface with a floor mopping device, the method comprising:

a) connecting a roll of webbing on a feed roller to a take-up roller;

b) transmitting control signals from an autonomous master controller to the floor mopping device;

c) moving the floor mopping device based on the control signals;

d) pressing on a portion of the webbing such that the webbing cleans a surface; and e) transferring the portion of the webbing to the take-up roller, wherein the transferring includes determining when the webbing is soiled.

35. A method of mopping a surface with a floor mopping device, the method comprising:

a) connecting a roll of webbing on a feed roller to a take-up roller;

b) transmitting control signals from an autonomous master controller to the floor mopping device;

c) moving the floor mopping device based on the control signals;

d) pressing on a portion of the webbing such that the webbing cleans a surface; and e) transferring the portion of the webbing to the take-up roller, wherein the transferring includes determining when the mopping device has cleaned a predetermined area of the surface.

36. The assembly of claim 5, wherein the second roller is not in the watertight compartment.

37. The assembly of claim 5, wherein the watertight compartment has a seal around an opening of the compartment, such that the webbing remains moistened between uses.

* * * * *